US012751517B2

(12) United States Patent
Hartlieb et al.

(10) Patent No.: US 12,751,517 B2
(45) Date of Patent: Oct. 6, 2026

(54) SYSTEMS AND METHODS FOR SMART HELMET

(71) Applicant: Polaris Industries Inc., Medina, MN (US)

(72) Inventors: Bill C. Hartlieb, Spokane, WA (US); Andrew J. Berg, Spokane, WA (US)

(73) Assignee: POLARIS INDUSTRIES INC., Medina, MN (US)

( * ) Notice: Subject to any disclaimer, the term of this patent is extended or adjusted under 35 U.S.C. 154(b) by 0 days.

(21) Appl. No.: 19/062,768

(22) Filed: Feb. 25, 2025

(65) Prior Publication Data

US 2025/0185749 A1 Jun. 12, 2025

Related U.S. Application Data

(63) Continuation of application No. 17/742,563, filed on May 12, 2022, now Pat. No. 12,256,799.

(60) Provisional application No. 63/188,248, filed on May 13, 2021.

(51) Int. Cl.
*A42B 3/30* (2006.01)
*A42B 3/16* (2006.01)

(52) U.S. Cl.
CPC ..... *A42B 3/306* (2013.01); *A42B 3/16* (2013.01); *A42B 3/163* (2013.01); *A42B 3/166* (2013.01)

(58) Field of Classification Search
CPC ..... A42B 3/306; A42B 3/16; A42B 3/163; A42B 3/166
See application file for complete search history.

(56) References Cited

U.S. PATENT DOCUMENTS

| | | | | |
|---|---|---|---|---|
| 4,700,410 | A * | 10/1987 | Westgate | A42B 3/166 2/209 |
| 10,455,314 | B1 * | 10/2019 | Yang | H04R 1/1008 |
| 10,779,074 | B1 * | 9/2020 | VanBlon | H04R 1/1008 |
| 2002/0161425 | A1 | 10/2002 | Hemerick et al. | |
| 2012/0102629 | A1 * | 5/2012 | Lott | H04R 1/1066 2/410 |
| 2022/0071336 | A1 * | 3/2022 | Franzino | A42B 3/0433 |

FOREIGN PATENT DOCUMENTS

| | | |
|---|---|---|
| CN | 2807837 | 8/2006 |
| CN | 206182459 | 5/2017 |
| CN | 208983055 | 6/2019 |
| DE | 3300183 A1 | 7/1984 |
| DE | 202009010212 U1 | 1/2010 |

(Continued)

OTHER PUBLICATIONS

"U.S. Appl. No. 17/742,563, Advisory Action mailed Nov. 8, 2024", 4 pgs.

(Continued)

*Primary Examiner* — Khaled Annis
(74) *Attorney, Agent, or Firm* — SCHWEGMAN LUNDBERG & WOESSNER, P.A.

(57) ABSTRACT

A helmet for a rider of an on-road or off-road vehicle protects the rider's head. The helmet also may include various features for enhancing the riding experience. For example, the helmet may include electrical connections for power various features of the helmet. Additionally, the helmet may include earmuffs which reduce road or other noises during operation of the vehicle.

16 Claims, 10 Drawing Sheets

(56) References Cited

FOREIGN PATENT DOCUMENTS

| | | | |
|---|---|---|---|
| DE | 102013213938 | A1 | 1/2015 |
| EP | 4337050 | | 4/2025 |
| JP | 2002161425 | A | 6/2002 |
| WO | WO-2022241065 | A1 | 11/2022 |

OTHER PUBLICATIONS

"U.S. Appl. No. 17/742,563, Examiner Interview Summary mailed Aug. 6, 2024", 2 pgs.
"U.S. Appl. No. 17/742,563, Final Office Action mailed Jul. 15, 2024", 10 pgs.
"U.S. Appl. No. 17/742,563, Non Final Office Action mailed Mar. 15, 2024", 11 pgs.
"U.S. Appl. No. 17/742,563, Notice of Allowance mailed Nov. 25, 2024", 7 pgs.
"U.S. Appl. No. 17/742,563, Response filed Mar. 4, 2024 to Restriction Requirement mailed Feb. 22, 2024", 5 pgs.
"U.S. Appl. No. 17/742,563, Response filed Jun. 27, 2024 to Non Final Office Action mailed Mar. 15, 2024", 8 pgs.
"U.S. Appl. No. 17/742,563, Response filed Nov. 1, 2024 to Final Office Action mailed Jul. 15, 2024", 6 pgs.
"U.S. Appl. No. 17/742,563, Response filed Nov. 8, 2024 to Advisory Action mailed Nov. 8, 2024", 6 pgs.
"U.S. Appl. No. 17/742,563, Restriction Requirement mailed Feb. 22, 2024", 6 pgs.
"European Application Serial No. 22808311.9, Extended European Search Report mailed Feb. 27, 2025", 9 pgs.
"European Application Serial No. 22808311.9, Response filed Oct. 9, 2025 to Extended European Search Report mailed Feb. 27, 2025", W English Claims, 15 pgs.
"European Application Serial No. 22808311.9, Response to Communication pursuant to Rules 1611 and 162 EPC filed Apr. 25, 2024", 9 pgs.
"Chinese Application Serial No. 202280034769.8, Office Action mailed Jun. 6, 2026", with English translation, 18 pages.

* cited by examiner

SYSTEMS AND METHODS FOR SMART HELMET

PRIORITY APPLICATIONS

This application is a divisional of U.S. patent application Ser. No. 17/742,563, filed May 12, 2022, which application claims the benefit of priority to U.S. Provisional Application Ser. No. 63/188,248, filed May 13, 2021, the contents of which are incorporated herein by reference in their entireties.

TECHNICAL FIELD

The present disclosure relates generally to a helmet and, more particularly, to a helmet for use when operating recreational vehicles.

BACKGROUND

Riders of recreational on-road vehicles, such as motorcycles, or off-road vehicles such as all-terrain vehicles (ATVs) and snowmobiles, often wear helmets to protect the rider's head. Helmets also may include various functions and features to improve the rider's overall riding experience.

SUMMARY

As set forth above, embodiments provided herein relate to voice capture for a recreational vehicle. Exemplary embodiments include but are not limited to the following examples.

In one aspect, a helmet includes a helmet shell defining a front opening and an electronics housing detachably attached to the exterior surface at a rear portion of the helmet shell opposite the front opening. The helmet shell has an interior surface and an exterior surface. The electronics housing includes electronic components that are configured to power and/or control one or more components of the helmet.

In some embodiments, the one or more components of the helmet may include a microphone, one or more speakers, and/or at least one brake light or tail-light LED.

In some embodiments, the helmet may further include a power connection system that is configured to electrically couple the electronics housing to a power source. The power connection system may include a power input port and a power port.

In some embodiments, the power input port may be supported at the interior surface of the helmet shell located near a bottom of the helmet.

In some embodiments, the power input port may be configured to receive a power cord of the power source, and electrically connect the helmet to the power source to allow the one or more components of the helmet to be connected directly to the power source.

In some embodiments, the power input port may be electrically connected to the electronics housing to provide power to the electronic components of the electronics housing.

In some embodiments, the power port may be configured to electrically connect to an external accessory to the helmet shell.

In some embodiments, the external accessory may include a heated helmet shield, heated goggles or eye protection, a camera equipment, and/or a lighting equipment.

In some embodiments, the helmet may further include a manual controller that is configured to be selectively activated and deactivated to perform various functions associated with the helmet. The various functions may include adjust volume, control Bluetooth connection, pair with a cell phone, play, stop, and pause music, answer incoming calls, refuse incoming calls, end calls, and/or connect to various voice-activated systems.

In another aspect, a helmet with a venturi vent system for providing moisture control is disclosed. The helmet includes a helmet shell having an interior surface and an exterior surface, and a venturi vent located on the exterior surface of the helmet shell. The venturi vent is configured to remove moisture from a helmet environment inside the helmet without allowing a free stream of air to enter the helmet environment.

In some embodiments, the venturi vent may include an inlet, an exhaust, a passageway defined between the inlet and the exhaust, a constricted section along the passageway, and a venturi hole located at the constricted section connecting the interior surface of the helmet shell and an interior of the venturi vent.

In some embodiments, the venturi vent may be configured to create a negative pressure as air mass travels through passageway at the constricted section to pull moist air from the helmet environment to the passageway.

In some embodiments, the helmet may further include a venturi controller that is configured to control a size of the venturi hole to adjust a level of warmth and moisture in the helmet environment inside the helmet.

In another aspect, a helmet with a noise cancelling system is disclosed. The helmet includes a helmet shell having an interior surface and an exterior surface, and earmuffs detachably coupled to the interior surface of the helmet shell. The earmuffs are positioned on each side of the helmet shell and include earmuff foams and an internal air pump system to reduce an amount of noise entering an interior of earmuffs.

In some embodiments, the internal air pump system may include an air bladder, a pump, and a pressure release valve. The pump and the pressure release valve may be configured to control an amount of air in the air bladder.

In some embodiments, the air bladder may be adapted to be inflated using the pump to push the respective earmuff foam against a helmet user's ear to create passive noise cancellation.

In some embodiments, the air bladder may be adapted to be deflated using the pressure release valve to pull the respective earmuff foam toward the interior surface of the helmet shell away from the helmet user's ear.

In some embodiments, each earmuff may be placed securely within a molded cavity defined in the interior surface of the helmet shell.

While multiple embodiments are disclosed, still other embodiments of the presently disclosed subject matter will become apparent to those skilled in the art from the following detailed description, which shows and describes illustrative embodiments of the disclosed subject matter. Accordingly, the drawings and detailed description are to be regarded as illustrative in nature and not restrictive.

BRIEF DESCRIPTION OF THE DRAWINGS

The above-mentioned and other features and advantages of this disclosure, and the manner of attaining them, will become more apparent and will be better understood by reference to the following description of embodiments of the invention taken in conjunction with the accompanying drawings, wherein.

Figure 1:
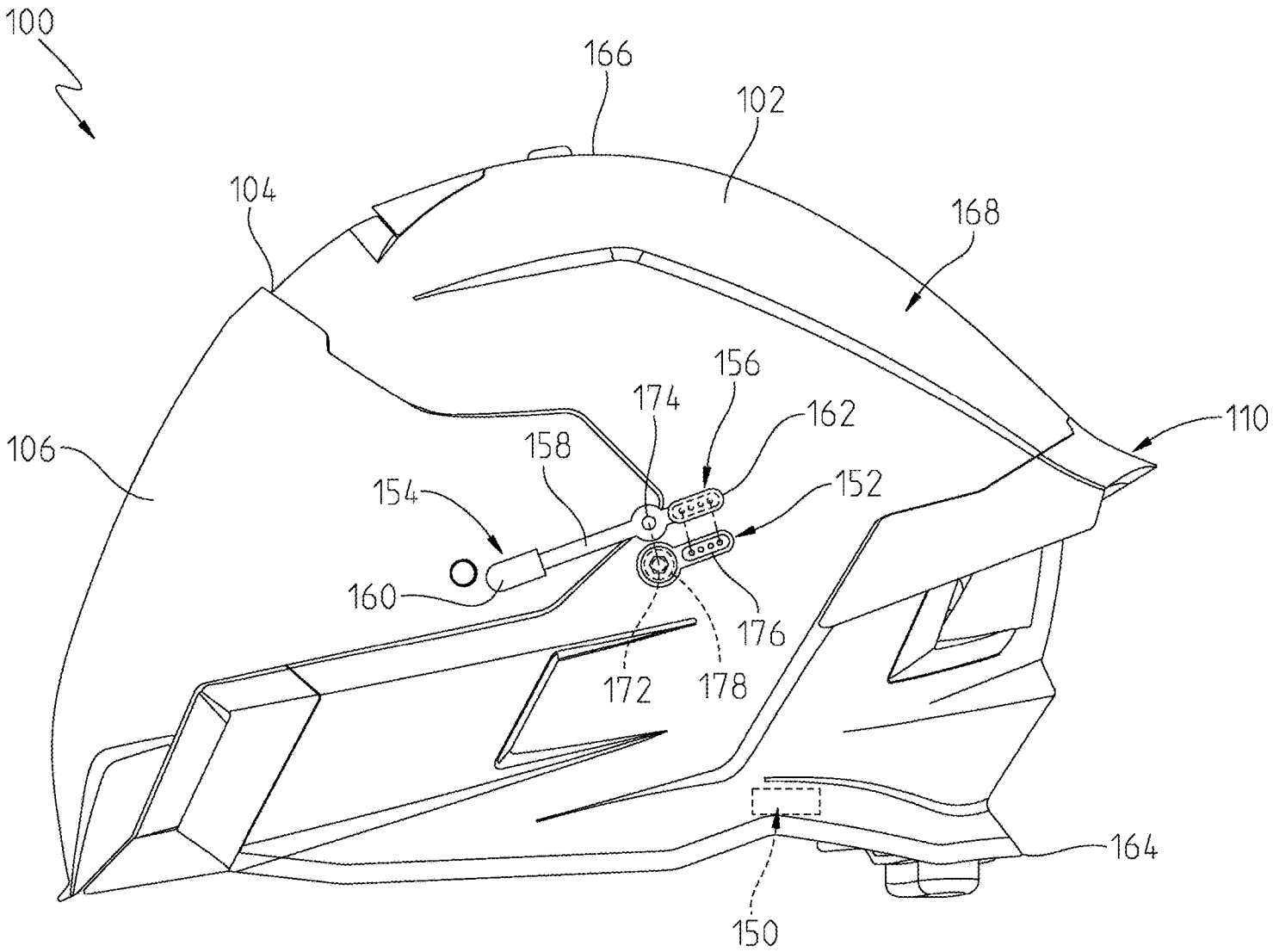
FIG. 1 is a side view of a helmet in accordance with certain embodiments of the present disclosure.

Corresponding reference characters indicate corresponding parts throughout the several views. Although the drawings represent embodiments of the present disclosure, the drawings are not necessarily to scale, and certain features may be exaggerated in order to better illustrate and explain the present disclosure. The exemplification set out herein illustrates an embodiment of the disclosure, in one form, and such exemplifications are not to be construed as limiting the scope of the disclosure in any manner.

DETAILED DESCRIPTION OF THE DRAWINGS

Various embodiments of the present disclosure will be described in detail with reference to the drawings, wherein like reference numerals represent like parts and assemblies throughout the several views. Reference to various embodiments does not limit the scope of the present disclosure, which is limited only by the scope of the claims attached hereto. Additionally, any examples set forth in this specification are not intended to be limiting and merely set forth some of the many possible embodiments for the present disclosure.

Referring to FIG. 1, a side view of a helmet 100 in accordance with an exemplary embodiment of the present disclosure is shown. Helmet 100 includes a helmet body or shell 102 defining a front opening 104. Helmet shell 102 includes an exterior surface 168 and an interior surface 138 (See FIG. 8) and extends from a bottom end 164 to a top end 166. Interior surface 138 defines a volume that is adapted to receive a user's head. In the illustrative embodiment, a viewing portion 106 is disposed over front opening 104. Viewing portion 106 may be configured as a transparent shield or may include or be defined as goggles attached to shell 102 and configured for the user to see through. In some embodiments, helmet 100 may further include a visor (not shown). Shield 106 and the visor are preferably detachably attached to helmet shell 102 of helmet 100. In the illustrative embodiment, a rear portion of helmet 100 may be defined as or include a spoiler 110. In one embodiment, spoiler 110 is detachably attached to the rear end of helmet shell 102 opposite shield 106.

Spoiler 110 includes electronic components or connections that are used to power and control one or more components of helmet 100, for example a microphone 170 (see FIG. 13), one or more speakers, and/or brake/tail-light LED(s). Because spoiler 110 is detachable from helmet shell 102 in various embodiments, spoiler 110 may be detached from shell 102, such that one or more components of spoiler 110 may be modified, serviced, upgraded (e.g., future renditions of electronic components), or replaced. Alternatively, the entirety of spoiler 110 may be replaced with another spoiler. Additionally or alternatively, the entirety of spoiler 110 may be integrated with another helmet shell.

In the illustrative embodiment, the user may use a manual control unit 150 of helmet 100 to turn on or off power supplied to spoiler 110. For example, the user may turn off spoiler 110 before detaching spoiler 110 from helmet shell 102 or turn on spoiler 110 after attaching spoiler 110 to helmet shell 102. In some embodiments, manual control unit 150 may also be used to control one or more components of spoiler 110. As shown in FIG. 1, manual control unit 150 is coupled to the interior surface 138 of helmet shell 102 near bottom end 164 of helmet 100.

Figure 2:
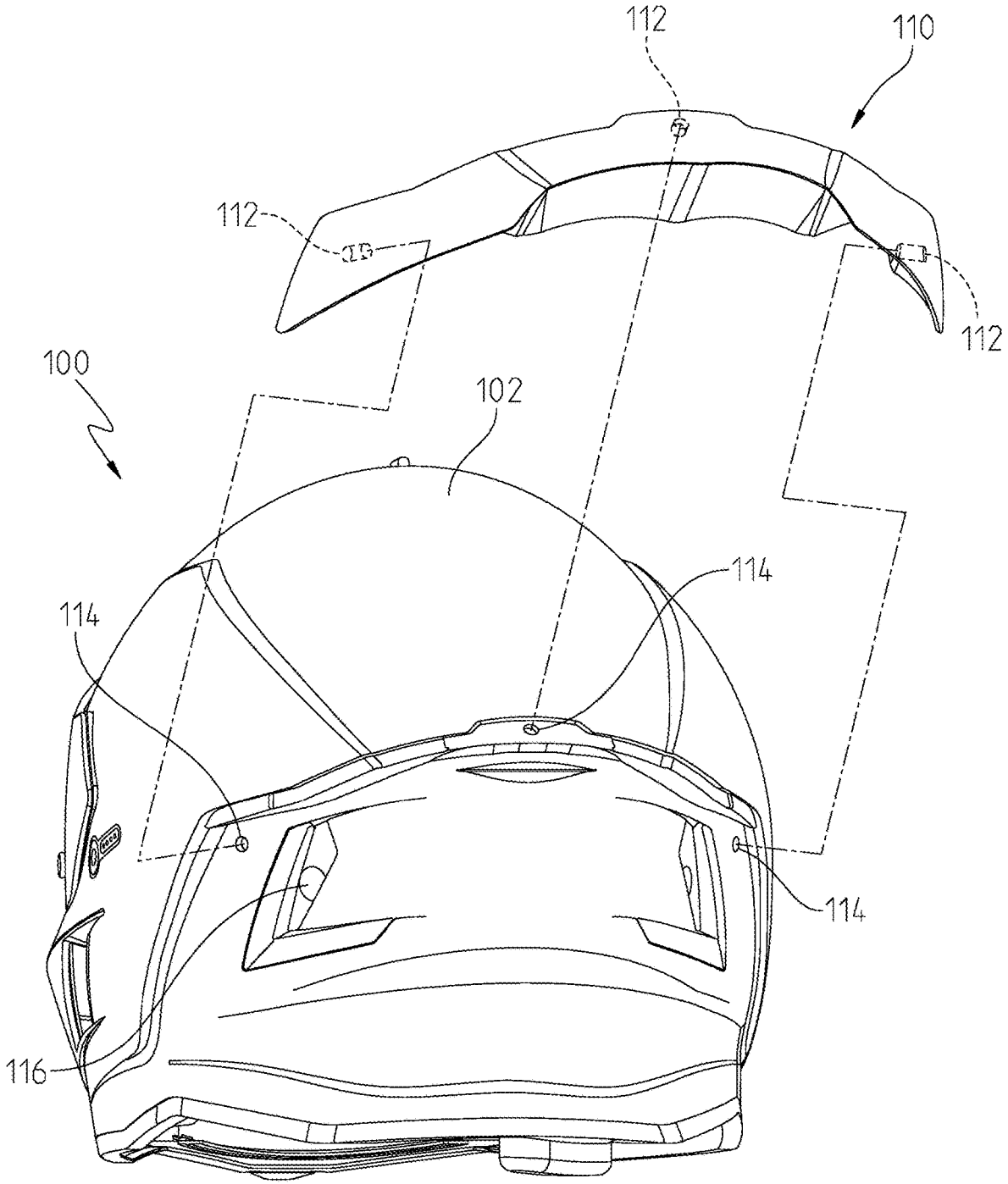
FIG. 2 is an exploded assembly view of a spoiler of the helmet of FIG. 1 and a helmet body or shell in accordance with certain embodiments of the present disclosure.

As shown in FIG. 2, spoiler 110 includes mounting posts 112 and helmet shell 102 includes access holes 114 adapted to receive mounting posts 112. In one embodiment, spoiler 110, including mounting posts 112, may be formed through injection mold processes and comprised of polycarbonate and/or acrylonitrile butadiene styrene (ABS) plastics. In other embodiments, spoiler 110 may be formed as such and mounting posts 112 are formed separately from spoiler 110 and coupled thereto. Spoiler 110 is attached to helmet shell 102 by providing mounting screws (not shown) through access holes 114 which extend into mounting posts 112. The mounting screws may be accessed from interior surface 138 of helmet shell 102 to assemble spoiler 110 to helmet shell 102 or remove spoiler 110 from helmet shell 102.

Figure 3:
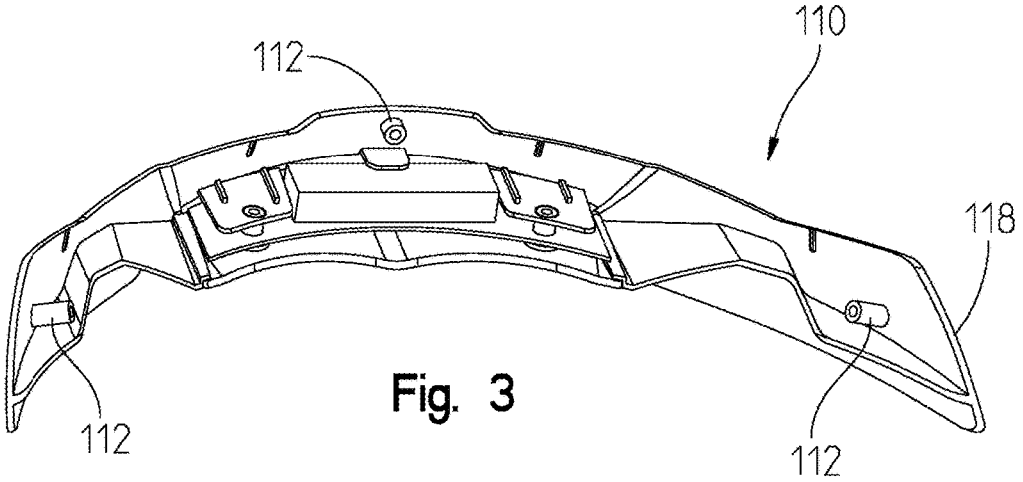
FIG. 3 is a perspective view of the spoiler of FIG. 2 in accordance with certain embodiments of the present disclosure.
Figure 4:
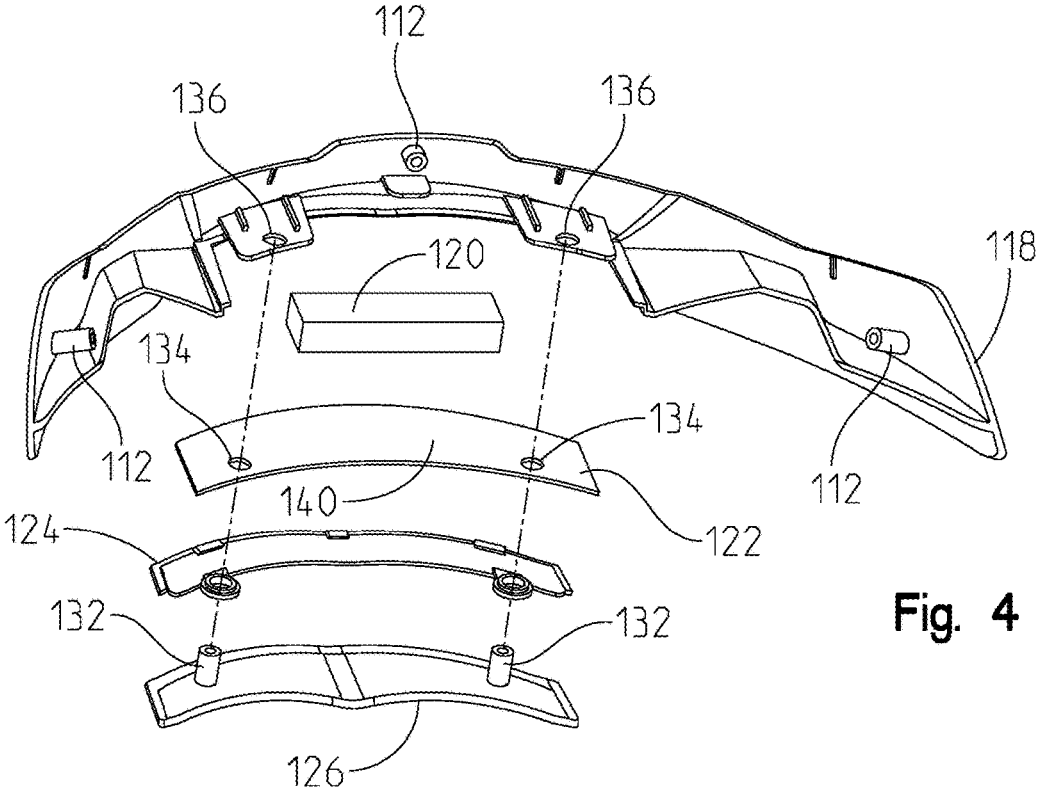
FIG. 4 is an exploded assembly view of the spoiler of FIG. 3.

As described above, spoiler 110 includes electronic components that are used to power and control one or more components of helmet 100. As shown in FIGS. 3 and 4, spoiler 110 includes an outer housing 118 configured to support the electronic components thereof. For example, outer housing 118 of spoiler 110 may support a battery 120, utility board 122, and an inner plate 126. To connect battery 120, utility board 122, and inner plate 126 to outer housing 118, inner plate 126 includes posts 132 that are inserted into holes 134 of utility board 122 and holes 136 of outer housing 118. Once posts 132 extend through holes 136, screws (not shown) are fastened into posts 132 to secure battery 120, utility board 122, a protective plate 124, and inner plate 126 to outer housing 118. For example, protective plate 124 may be made of clear acrylic material to cover and protect utility board 122, such that one or more components of utility board 122 (e.g., LEDs) are visible from the outside of helmet 100. Additionally, it should be appreciated that inner plate 126 is shaped, such that one or more components of utility board 122 (e.g., LEDs) are visible from the outside of helmet 100.

Figure 5:
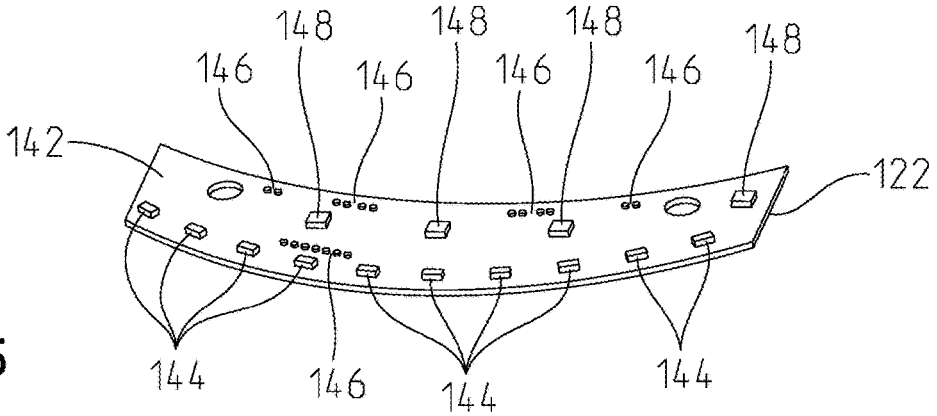
FIG. 5 is a perspective view of an electrical connection of the spoiler of FIG. 3.

In the illustrative embodiment, utility board 122 is embodied as a printed circuit board assembly (PCBA), which serves as a controller for all electronic helmet functions. To do so, utility board 122 includes electronic components that are configured to be communicatively coupled to various internal components of helmet 100 that are stored in helmet shell 102. For example, the internal components may include a heated shield contact for viewing portion 106, one or more speakers supported by shell 102, and microphone 170 supported by shell 102. Utility board 122 includes an outer surface 140 and an inner surface 142 facing toward helmet shell 102. As shown in FIG. 5, inner surface 142 includes electronic components, such as a plurality of light-emitting diodes (LEDs) 144. For example, LEDs 144 may be used for a break light, a taillight, and/or turn signals. Inner surface 142 further includes a plurality of connectors 146 and a plurality of modules 148 (e.g., Bluetooth chip, speaker amplifier, G force, and/or LED driver). In some embodiments, utility board 122 may include a video graphic card to allow heads up display (e.g., cockpit type display) built into helmet 100. In certain embodiments, utility board 122 may include safety technology to determine whether to send a SOS or help signal based on movement of the rider. It may also support longer range communication channel(s). Additionally, utility board 122 may be customized to provide features tailored to a specific rider without changing existing form and aerodynamic function of helmet 100. In various embodiments, utility board 122 may comprise a single board or a plurality of boards. In various embodiments, a plurality of utility boards 122 may be stacked on top of each other, or side by side each other. Additional details of features of helmet 100, such as anti-fog features for viewing portion 106, may be disclosed in U.S. patent application Ser. No. 17/143,974, filed Jan. 7, 2021, and entitled "GOGGLE WITH ANTI-FOG LENS", the complete disclosure of which is expressly incorporated by reference herein. Moreover, additional details of features of helmet 100, such as electronic control features, may be disclosed in U.S. patent application Ser. No. 16/668,980, filed Oct. 30, 2019, and entitled "CONNECTED HELMET SYSTEM AND METHOD OF OPERATING THE SAME," the complete disclosure of which is expressly incorporated by reference herein.

Referring back to FIG. 1, helmet 100 further includes a built-in power connection system that is configured to provide power to one or more electrical components of helmet 100. Power connection system includes a power input port 150, a power port 152, and electric wiring, which is housed internally within helmet shell 102 (i.e., between exterior surface 168 and interior surface 138 of helmet shell 102).

Power input port 150 is configured to connect helmet 100 to a power source to allow electrical components of helmet 100 to be connected directly to the power source. Power input port 150 is positioned on helmet 100 where a user can easily access to plug or unplug a power cord of the power source. For example, in the illustrative embodiment, power input port 150 is coupled to interior surface 138 of helmet shell 102 located near bottom 134 of helmet 100 as shown in FIGS. 1 and 13. Power input port 150 includes a female plug 160 (see FIG. 13) (e.g., 12 V 3 A DC female plug) and a manual controller 162 (see FIG. 13). Female plug 160 is configured to receive a power cord from the power source. Manual controller 162 may be a rubberized rotary wheel controller with a click button. Manual controller 162 may also define different configurations and, more particularly, may be configured as any controller configured to be selectively activated and deactivated by the user to perform various functions associated with helmet 100. For example, manual controller 162 may be customized to adjust volume, control Bluetooth connection, pair with a cell phone, play, stop, and pause music, answer incoming calls, refuse incoming calls, end calls, and/or connect to various voice-activated systems.

Additionally, power input port 150 is internally connected to a controller (e.g., PCBA) that controls all electronic helmet functions via internal electrical wiring. In the illustrative embodiment, power input port 150 is internally connected to spoiler 110 via electrical wire within helmet shell 102 to provide power to PCBA and other electrical components on spoiler 110. Additionally, power input port 150 is internally connected to power port 152.

Power port 152 is configured to connect one or more external components to the powered helmet shell 102. To do so, power port 152 has a power connector 176 and a second hole 172 at the opposite end of power connector 176. For example, as shown in FIG. 1, power connector 176 may be a 4-pin female connector. One or more additional external accessories may be plugged into power port 152 to be added onto helmet 100. Additional external accessories may include, but are not limited to, a heated/powered helmet shield, heated/smart goggles or eye protection, a camera equipment, and/or a lighting equipment. Although only one power port 152 is shown in FIG. 1, it should be appreciated that, in some embodiments, helmet 100 may include multiple power ports.

For example, in the illustrative embodiment, shield 106 is an external accessory connected to helmet 100. Shield 106 includes a shield port 154 that has a first portion 160, a second portion 162, and a power connection cord 158 connecting second portion 162 to first portion 160. For example, power connection cord 158 may be embodied as a stainless braided wire. First portion 160 of shield port 154 is securely attached to shield 106, and second portion 162 of shield port 154 has a shield connector 156 that is configured to be coupled to power connector 176. Shield port 154 further includes a first hole 174 near shield connector 156. For example, as shown in FIG. 1, shield connector 156 may be a 4-pin male connector, which is adapted to be coupled to the 4-pin female connector 176 of power port 152 to receive power. It should be appreciated that the 4-pin connection allows helmet 100 to perform more than one operation of the external accessories (e.g., heated shield on/off control, temperature/humidity sensor, and/or LED control).

To support the structure and security of the connection created between power port 152 and shield 106, a connection is accompanied by a threaded opening 178 (e.g., a threaded rivet) tooled into a side of helmet shell 102. Threaded opening 178 is configured to accept a particular hardware fastener having a specified metric thread to securely couple shield 106 and power port 142 to helmet shell 102. To do so, the hardware fastener is placed through first hole 174 and second hole 172 then is treaded into threaded opening 178 tooled into helmet shell 102. This creates a secure mounting point between power port 152 and shield 106.

Figure 6:
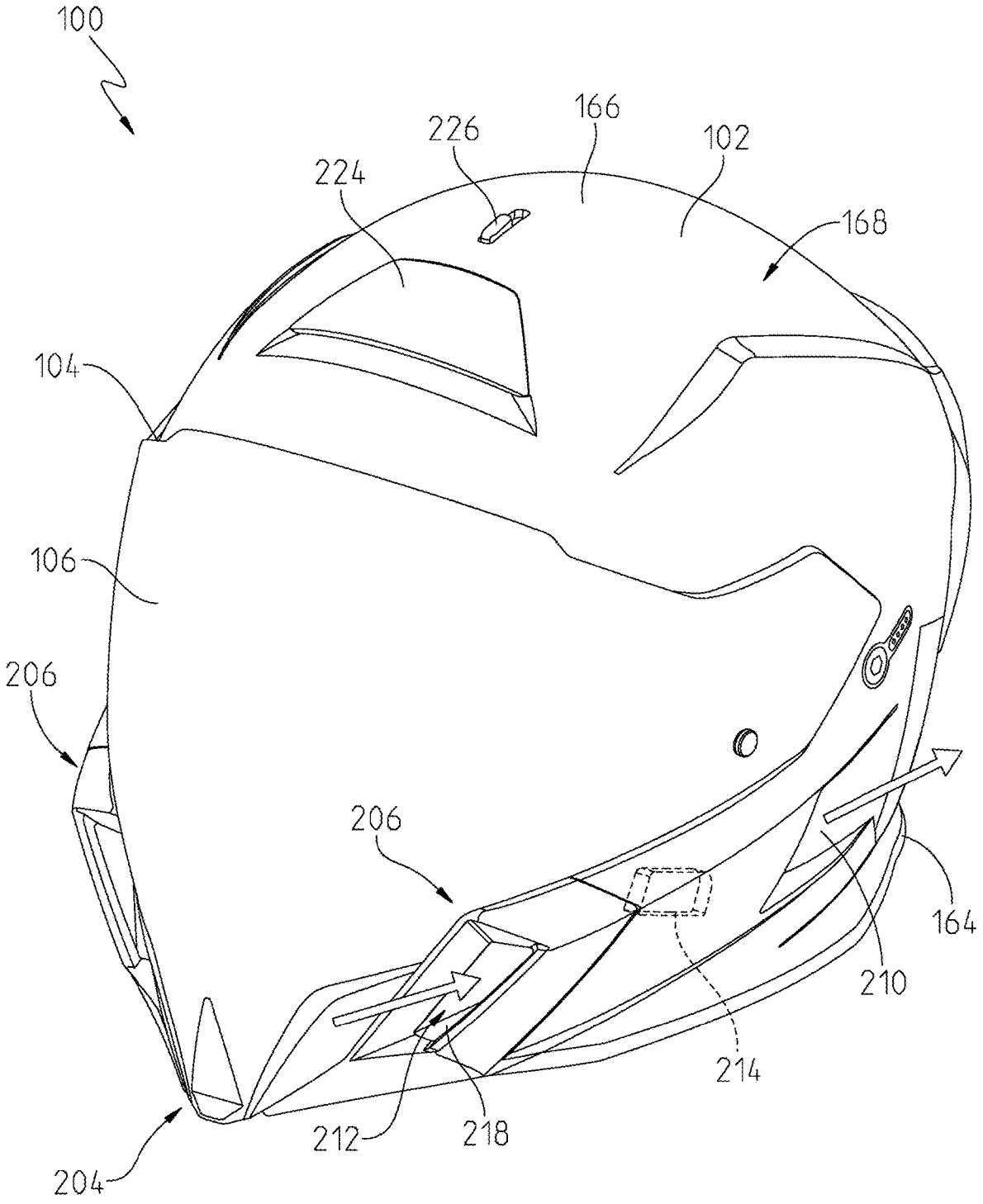
FIG. 6 is a front perspective view of the helmet of FIG. 1 in accordance with certain embodiments of the present disclosure.

Referring now to FIG. 6, helmet 100 may include a venturi vent system for providing moisture control. Helmet 100 includes a breath box 204 and venturi vents 206 located on an exterior of helmet shell 102 on each side of breath box 204. Venturi vent 206 is configured to remove moisture from a helmet environment inside helmet 200 without allowing a free stream of air to enter the helmet environment to allow a rider an optimized riding experience. To do so, venturi vent 206 includes an inlet 218, an exhaust 210, a passageway 212 defined between inlet 218 and exhaust 210, a constricted section along passageway 212, and a venturi hole 214 located at the constricted section. Venturi hole 214 is an opening that connects an interior of helmet shell 100 and an interior of venturi vent 206. It should be appreciated that, in some embodiments, helmet 100 may include a venturi controller (not shown) to control a level of warmth and moisture inside helmet 100 by adjusting a size of venturi hole 214.

During rides, air mass enters venturi vent 206 through inlet 218. As the air mass travels through passageway 212 of venturi vent 206, a negative pressure is created at the constricted section. The pressure is used to pull moist air from a helmet environment to passageway 212 through venturi hole 214, thereby removing moisture found in the rider's breath exhale inside of helmet 100. The moisture air then exits passageway 212 via exhaust 210 of venturi vent 206. It should be appreciated that the air mass entering venturi vent 206 does not flow into the helmet environment inside helmet 200. A rider who enjoys high speed rides at cold temperature would appreciate that venturi vent 206 removes moisture from the helmet environment while minimizing cold air from entering helmet 200 and keeping the helmet environment warm.

It should be appreciated that, in some embodiments, helmet 100 may include a chin curtain (not shown) that allows a free stream of air to flow in and out of the helmet environment. In such embodiments, the chin curtain is made of meshed fabric and is located at bottom end 164 of helmet 100, which minimizes unwanted excess of air flowing from the front of helmet 100, into the helmet environment, and directly onto a rider's face during a long endurance speed ride at cold temperature.

In the illustrative embodiment, helmet 100 further includes a top vent 224 and a rear vent (not shown). Each vent connects interior of helmet shell 102 to exterior 168 of helmet shell 102 to allow air to flow into or from the helmet environment. As shown in FIG. 6, top vent 224 has a controller 226 that allows for moisture and temperature management. For example, controller 226 is an on-and-off switch that may be used to open and close top vent 224 to control the level of warmth and moisture inside helmet 100. Similarly, rear vent may have its corresponding controller that functions as an on-and-off switch to open and close rear vent to control the level of warmth and moisture inside helmet 100.

Although helmet 100 is illustrated as a closed face helmet (e.g., including shield 106), in some embodiments, helmet 100 may be embodied as an open face helmet with a face protector and venturi vent 206. The face protector may be a built-in, balaclava-type face protector. However, in some embodiments, the face protector may be removable. The face protector may be made of neoprene, windproof material and is used to seal a breath box and an eye port from exposure to full wind during rides. In such embodiments, a rider may wear a goggle to rest over the top of the breath box integrated with the face protector. The face protector works in conjunction with venturi vent 206 to minimize free stream air entering the helmet environment (e.g., inside the face protector) and maximize breath box venting.

Figure 7:
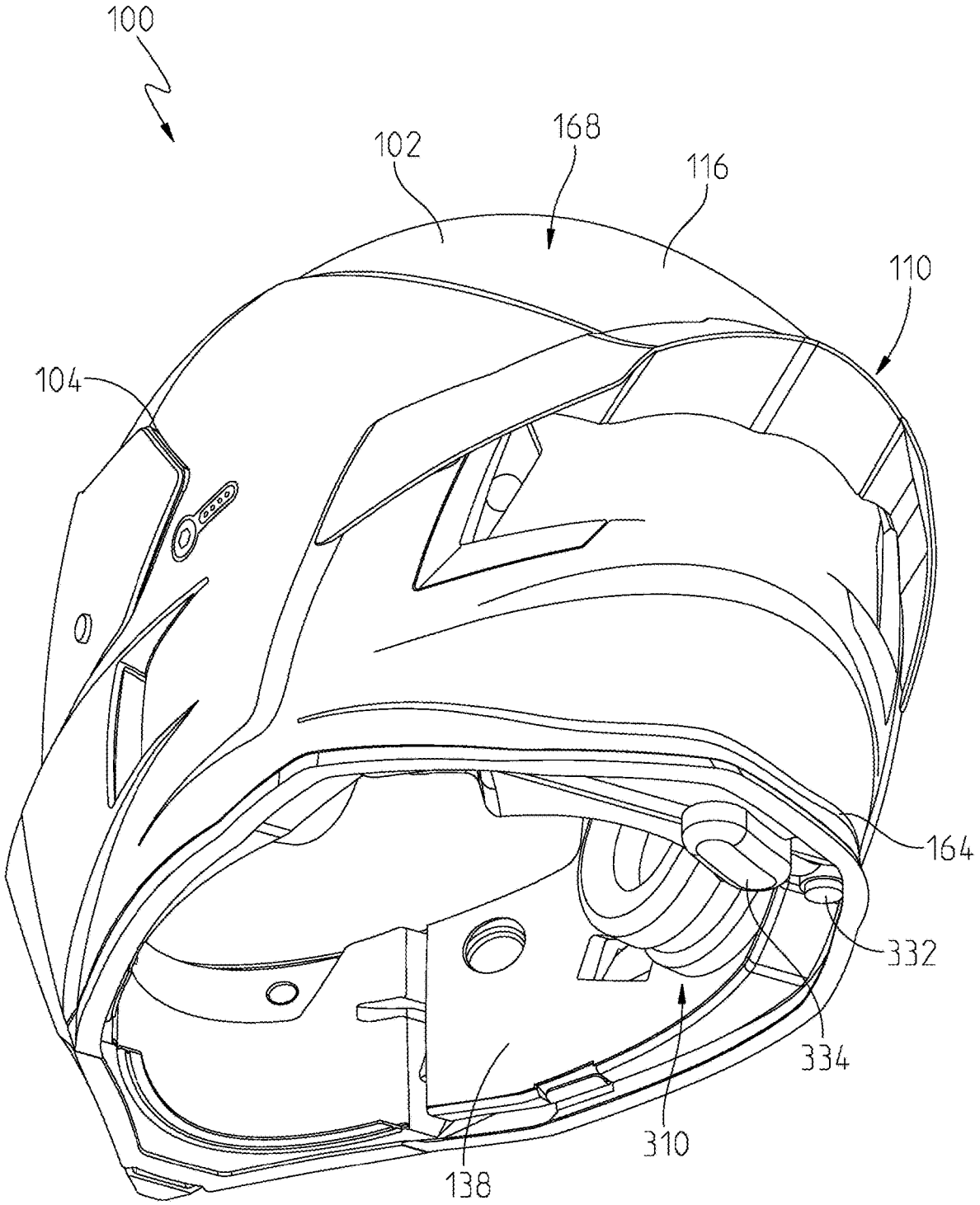
FIG. 7 is a rear bottom perspective view of the helmet of FIG. 1 in accordance with certain embodiments of the present disclosure.

Referring now to FIG. 7, helmet 100 may include earmuffs 310 with a built-in speaker system and an internal air pump system is shown. Earmuffs 310 are ergonomically shaped to fit over the user's ears, and the internal air pump system is configured to reduce an amount of noise (e.g., wind, engine noise, and road noise) entering an interior of earmuffs 310. More particularly, helmet 100 includes a pair of earmuffs 310, one on each side of interior surface 138 of helmet shell 302. In the illustrative embodiment, earmuffs 310 are noise cancelling earmuffs. Additional details of features of helmet 100, such as noise cancelling features, may be disclosed in U.S. patent application Ser. No. 17/234,501, filed Apr. 19, 2021, and entitled "SYSTEMS AND METHODS FOR COMMUNICATING INFORMATION", U.S. patent application Ser. No. 17/234,518, filed Apr. 19, 2021, and entitled "SYSTEMS AND METHODS FOR COMMUNICATING INFORMATION", U.S. patent application Ser. No. 17/234,521, filed Apr. 19, 2021, and entitled "SYSTEMS AND METHODS FOR COMMUNICATING INFORMATION", and U.S. patent application Ser. No. 17/234,524, filed Apr. 19, 2021, and entitled "SYSTEMS AND METHODS FOR COMMUNICATING INFORMATION", the complete disclosures of which are expressly incorporated by reference herein.

The built-in speaker system includes a speaker 316 (See FIG. 9) inside of each earmuff 310 to transmit audible sound to the user. Speaker 316 may be any electronic device that is capable of producing sound in response to an electrical audio signal input. For example, speaker 316 may be a 3 cm flat circular-shaped speaker with two wires and a 2-pin connector. In the illustrative embodiment, the electrical audio signal input may be received from a vehicle (e.g., a vehicle that the user is riding) via speaker 316 for voice commands, phone communications, and/or radio communications (e.g., vehicle-to-vehicle communications). In some embodiments, the electrical audio signal input may be directly received from a communication system of another wearable device (e.g., another helmet) to receive communications or messages from another user. In other embodiments, a communication system of the helmet 100 may be communicatively coupled to a helmet user's mobile device. In such cases, the electrical audio signal input may be directly received from the helmet user's mobile device to, for example, deliver audio conversations during a phone call, play music, and/or play back a text message or email to the user via speaker 316.

Figure 8:
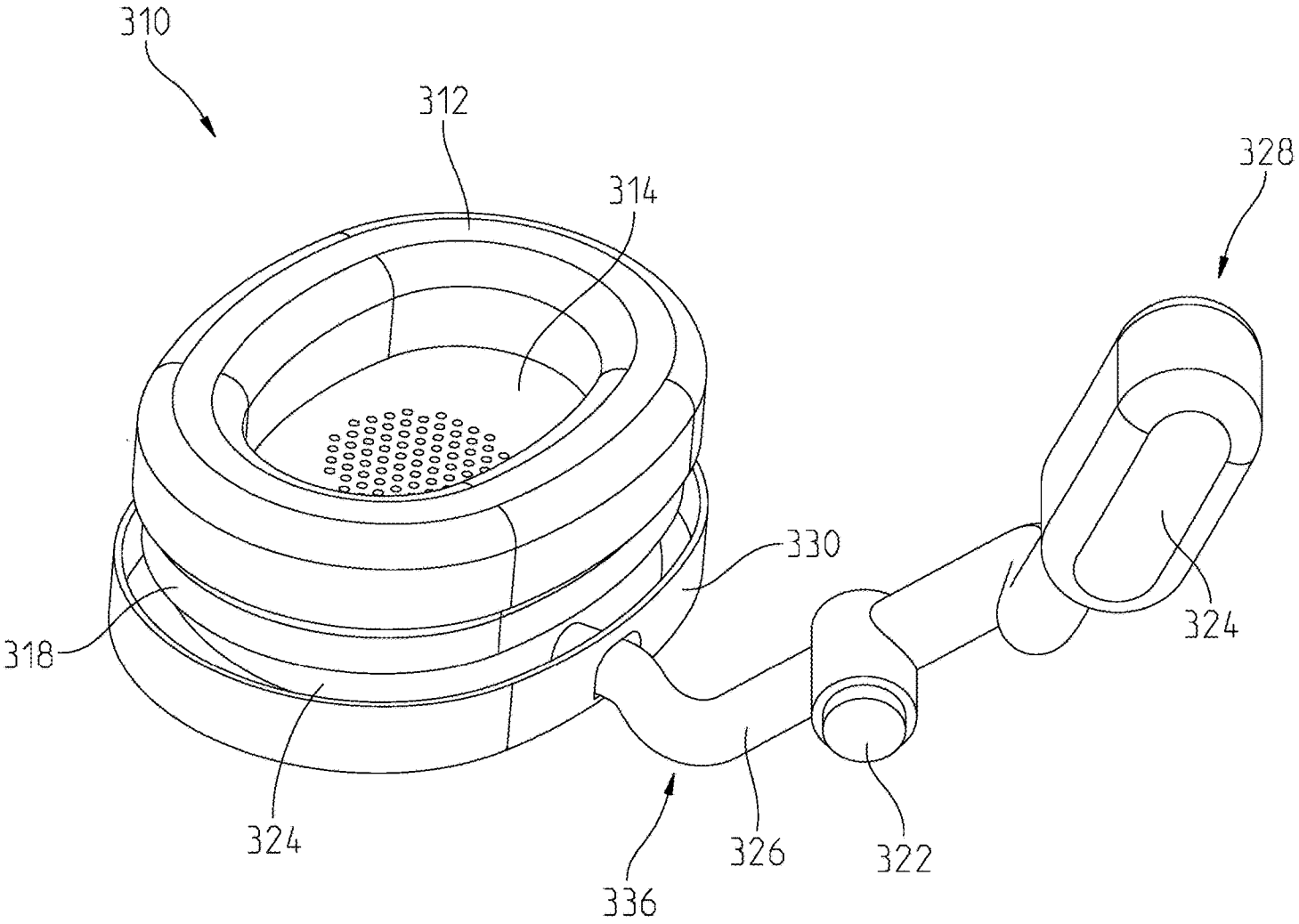
FIG. 8 is a perspective view of an earmuff of the helmet of FIG. 1.
Figure 9:
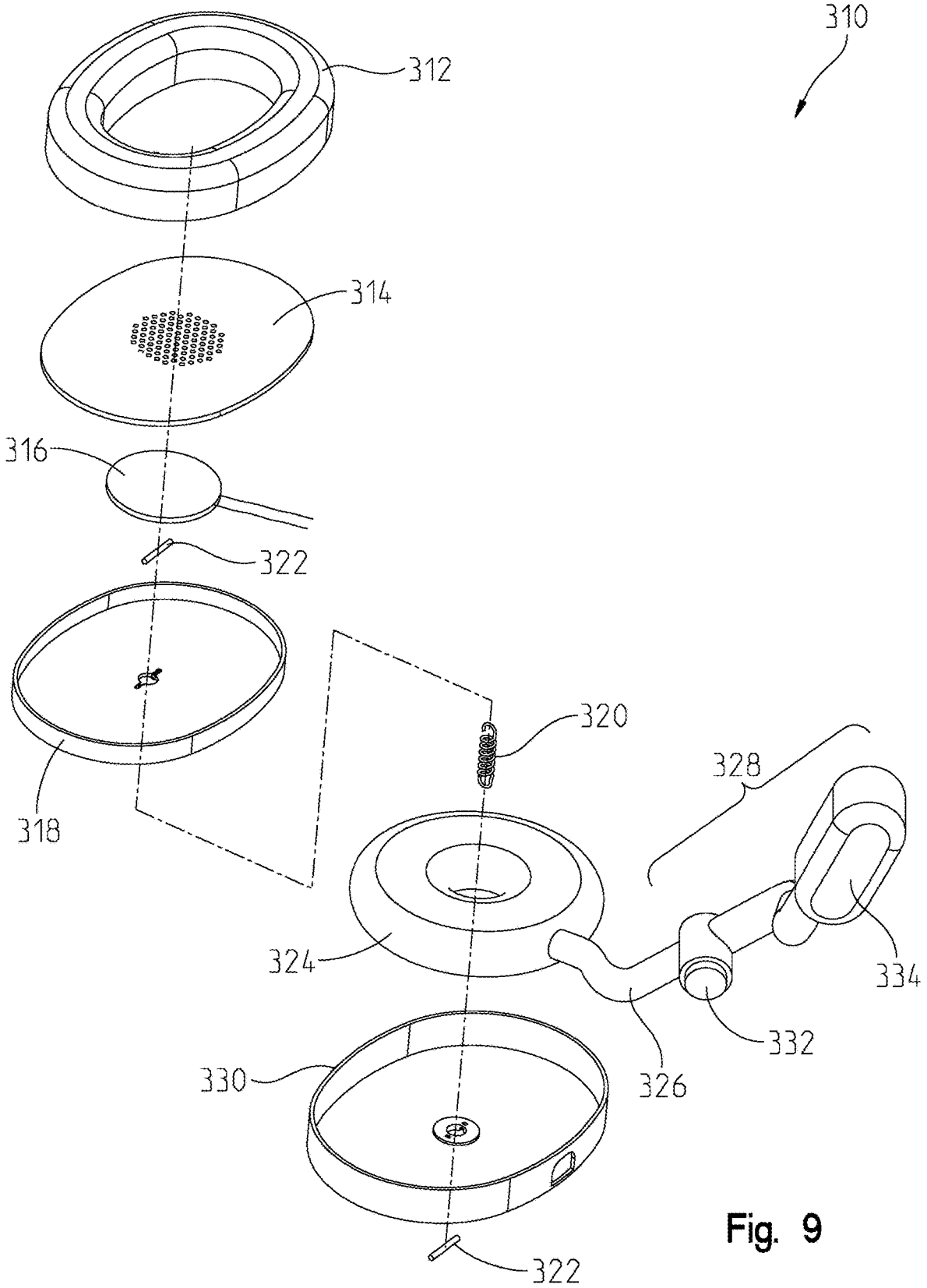
FIG. 9 is an exploded assembly view of the earmuff of FIG. 8.
Figure 10:
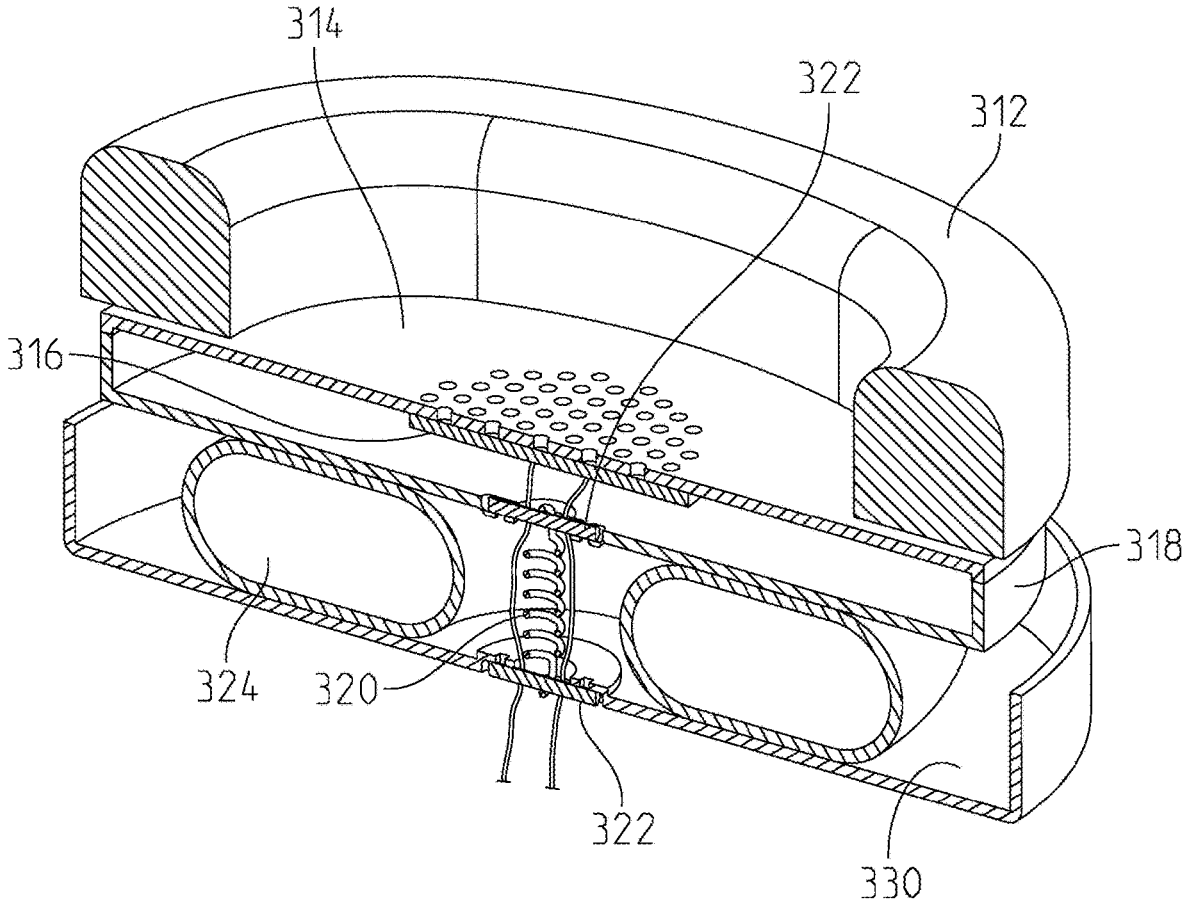
FIG. 10 is a cross sectional view of the earmuff of FIG. 8.
Figure 11:
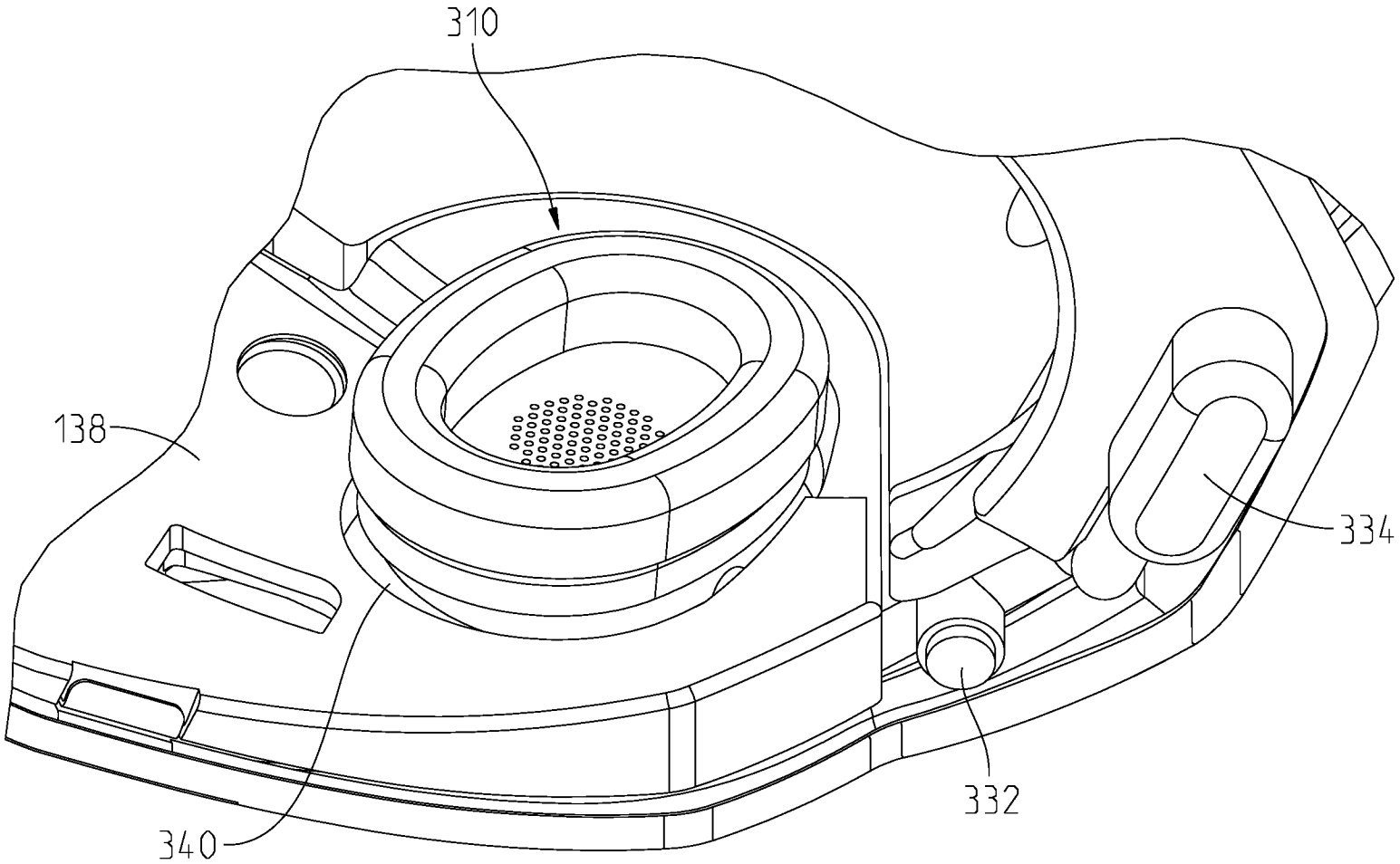
FIG. 11 is a perspective view of the earmuff attached to the helmet shown in the previous figures.

As shown in FIGS. 8-10, each earmuff 310 includes earmuff foam 312, an internal speaker housing 314, speaker 316, a speaker housing shell 318, an internal air pump system 336, and an external housing 330. Additionally, internal air pump system 336 includes an air bladder 324, an airline 326 connected to air bladder 324, and an internal spring 320 attached to a pin 322 on each end of spring 320 to secure air bladder 324 between speaker housing shell 318 and external housing 330. Although it is not shown, airline 326 includes a splitter (not shown) that is adapted to split airline 326, such that airline 326 is also connected to the other air bladder 324 of the other side of earmuff 310.

In the illustrative embodiment, airline 326 further includes plumbing attachments 328 to control an amount of air in air bladders 324 in both earmuffs 310. Plumbing attachments 328 include a pump 334 and a pressure release valve 332. Pump 334 and pressure release valve 332 are buttons that can be pressed to inflate and deflate air bladders 324, respectively. In the illustrative embodiment, pump 334 and pressure release valve 332 are coupled to interior surface 138 of helmet shell 102 near bottom end 164 of the helmet 100, as shown in FIG. 7, such that they are not visible on exterior surface 168 of helmet 100.

In use, a user of helmet 100 may manually pump air into air bladders 324 housed within earmuff external housings 330 using pump 334 to push earmuff foams 312 against the user's ear. Specifically, when the user presses pump 334, air is pumped into air bladders 324 to push speaker housing shells 318 towards the user's ear. This creates passive noise cancellation, better sound quality, and an overall improved user experience. As air bladders 324 inflate, internal springs 320 become longer. In the illustrative embodiment, each earmuff 310 expands to about 5 cm when air bladder 324 is fully expanded.

The user may deflate air bladders 324 using pressure release valve 332 to pull earmuff foams 312 away from the user's ear. When the user presses pressure release valve 332, the air is released from air bladders 324. As air bladders 324 deflate, internal springs 320 become shorter, thereby pulling speaker housing shells 318 toward external housings 330. For example, the user may deflate air bladders 324 when removing helmet 100. In the illustrative embodiment, each earmuff 310 collapsed to about 3.5 cm when air bladder 324 is emptied.

As discussed above, in the illustrative embodiment, both earmuffs 310 are connected to the same airline 326 with a single pump 334 and a single release valve 334 to control an amount of air in air bladders 324 of both earmuffs 310. However, in some embodiments, each earmuff 310 may include its own pump and release valve to control the respective air bladder 324. It should be appreciated that, in certain embodiments, only one earmuff 310 may include air bladder 324 and may be connected to pump 334 and release valve 334.

Figure 12:
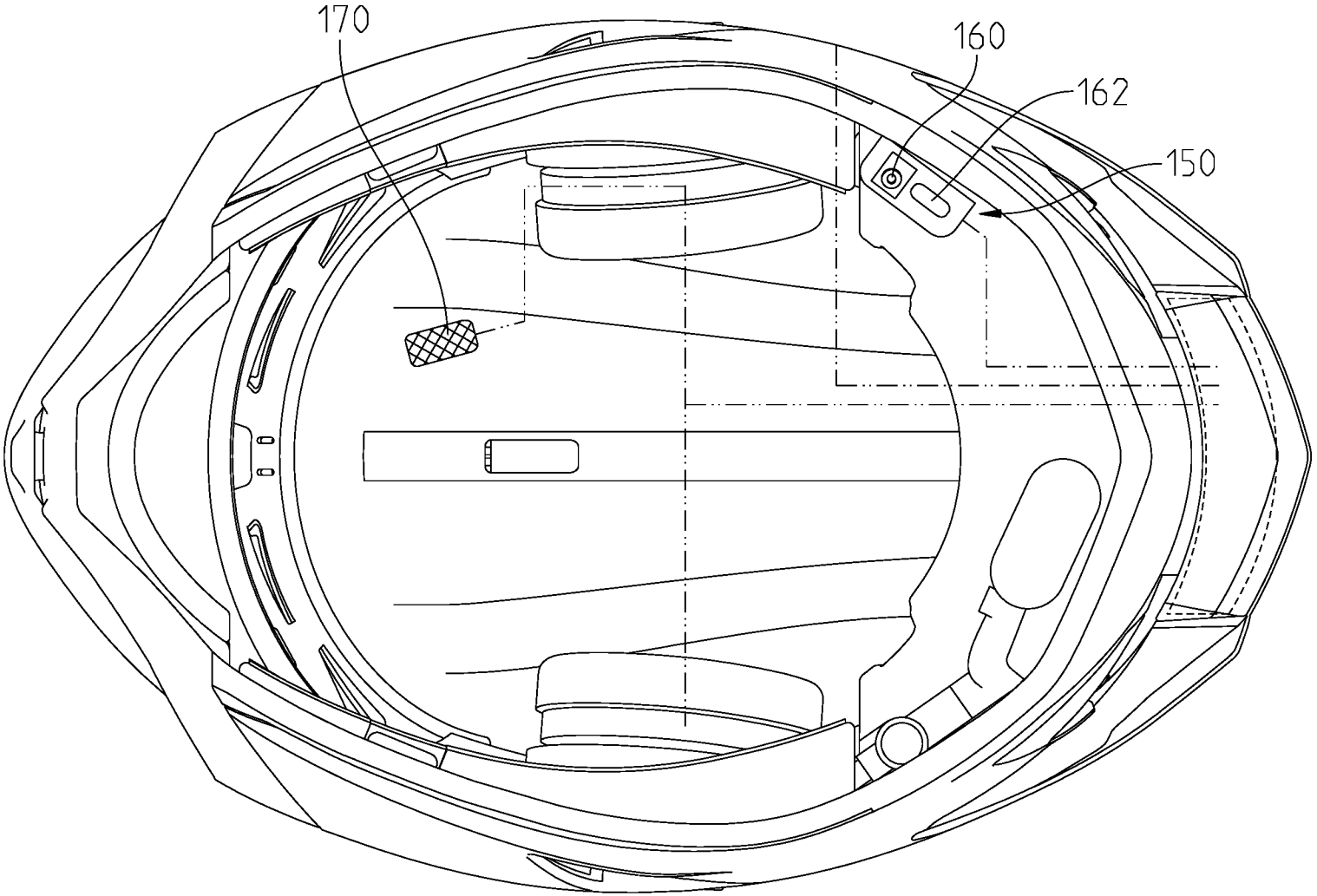
FIG. 12 is a bottom view of the helmet of FIG. 1 in accordance with certain embodiments of the present disclosure.

In the illustrative embodiment, each earmuff 310 is detachably coupled to interior surface 138 of helmet shell 302. Earmuff 310 may be detached from helmet shell 102 to be serviced, upgraded (e.g., future renditions of electronic components), or replaced. As shown in FIG. 12, when earmuff 310 is coupled to helmet shell 102, earmuff 310 is placed within a molded cavity 340 defined in interior surface 138 of helmet shell 102. To do so, molded cavity 340 is shaped to receive external housing 330 of earmuff 310. External housing 330 may be made of water-resistant acrylonitrile butadiene styrene (ABS). To detach earmuff 310, an appropriate pad liner (e.g., cheek pad liner) on interior surface 138 of helmet shell 102 is removed to expose a corresponding portion of interior surface 138 (e.g., interior surface around cheek area which is made of expanded polystyrene (EPS)). Subsequently, a speaker connector and an earmuff airline are disconnected from helmet 100 and then earmuff 310 is removed from helmet shell 102. Once earmuff 310 is detached from helmet shell 102, one or more appropriate components of earmuff 310 may be serviced, upgraded, or replaced.

The above specification, examples and data provide a complete description of the manufacture and use of the composition of the invention. Since many embodiments of the invention can be made without departing from the spirit and scope of the invention, various embodiments of the invention reside in the claims hereinafter appended.

What is claimed is:

1. A helmet with passive noise cancellation, the helmet comprising:
- a helmet shell configured to be worn on a head of a user;
- an earmuff disposed in an interior of the helmet shell, the earmuff including:
  - an external housing surrounding an ear cavity; and
  - a bladder within the external housing and at least partially surrounding the ear cavity;
- a pump in communication with the bladder, the pump being configured to inflate the bladder, the inflation of the bladder being configured to push the external housing toward a portion of the head proximate an ear of the user to increase passive noise cancellation for the user; and
- a biasing element coupled to the bladder and configured to bias the bladder to a deflated position, the biasing element comprising an internal spring configured to lengthen with inflation of the bladder and contract with deflation of the bladder.

2. The helmet of claim 1, wherein the pump is coupled to an interior surface of the helmet shell near a lower end of the helmet shell, such that the helmet shell conceals the pump.

3. The helmet of claim 1, wherein the earmuff further includes earmuff foam configured to contact the head of the user and surround the ear of the user, the inflation of the bladder being configured to push the earmuff foam toward the head of the user to increase the passive noise cancellation for the user.

4. The helmet of claim 3, further comprising:
- a pressure release valve in communication with the bladder and configured to at least partially deflate the bladder to relax the earmuff foam relative to the portion of the head proximate the ear of the user to decrease the passive noise cancellation for the user.

5. The helmet of claim 4, wherein the pressure release valve is coupled to an interior surface of the helmet shell near a lower end of the helmet shell, such that the helmet shell conceals the pressure release valve.

6. The helmet of claim 4, wherein the pressure release valve is further configured to at least partially deflate the bladder in preparation for removal of the helmet shell from the head of the user.

7. The helmet of claim 4, wherein:
- the bladder is a first bladder;
- the external housing is a first external housing;
- the earmuff is a first earmuff;
- the ear cavity is a first ear cavity; and
- the helmet further comprises:
  - a second earmuff disposed in the interior of the helmet shell, the second earmuff including:
    - a second external housing surrounding a second ear cavity; and
    - a second bladder within the second external housing and at least partially surrounding the second ear cavity.

8. The helmet of claim 7, wherein:
- the pump is in communication with the first bladder and the second bladder;
- the pump is further configured to simultaneously inflate the first bladder and the second bladder; and
- the inflation of the second bladder is configured to push the second external housing toward a portion of the head proximate a second ear of the user to increase the passive noise cancellation for the user.

9. The helmet of claim 7, wherein:
- the ear is a first ear; and
- the second earmuff further includes second earmuff foam configured to contact the head of the user and surround a second ear of the user, the inflation of the second bladder being configured to push the second earmuff foam toward the head of the user to increase the passive noise cancellation for the user.

10. The helmet of claim 9, wherein the pressure release valve is further configured to simultaneously at least partially deflate the second bladder to relax the second earmuff foam relative to the portion of the head proximate the second ear of the user to decrease the passive noise cancellation for the user.

11. A method for operating a helmet with passive noise cancellation, the method comprising:
- positioning the helmet over a head of a user, the helmet includes an exterior shell and an earmuff;

controlling passive noise cancellation provided by the helmet, controlling the passive noise cancellation including one or more of:

inflating a bladder of the earmuff, inflating the bladder comprising expanding the bladder toward a portion of the head proximate an ear of the user and increasing the passive noise cancellation; or deflating the bladder of the earmuff, deflating the bladder comprising relaxing the bladder relative to the portion of the head proximate the ear of the user and decreasing the passive noise cancellation; and biasing the bladder to a deflated position using an internal spring coupled to the bladder.

12. The method of claim 11, wherein inflating the bladder of the earmuff comprises:

pumping air into the bladder using a pump in communication with the bladder, the exterior shell concealing the pump.

13. The method of claim 11, wherein deflating the bladder of the earmuff comprises:

activating a pressure release valve in communication with the bladder, the exterior shell concealing the pressure release valve.

14. A helmet with passive noise cancellation, the helmet comprising:

a helmet shell configured to be worn on a head of a user;

a first earmuff disposed in an interior of the helmet shell, the first earmuff including:

a first external housing surrounding a first ear cavity; and a first bladder within the first external housing and at least partially surrounding the first ear cavity, the first bladder being inflatable to push the first external housing toward a portion of the head proximate a first ear of the user to increase passive noise cancellation for the user;

a second earmuff disposed in the interior of the helmet shell, the second earmuff including:

a second external housing surrounding a second ear cavity; and a second bladder within the second external housing and at least partially surrounding the second ear cavity, the second bladder being inflatable to push the second external housing toward a portion of the head proximate a second ear of the user to increase passive noise cancellation for the user, the first bladder and the second bladder being coupled to inflate simultaneously;

a first internal spring configured to bias the first bladder to a deflated position; and a second internal spring configured to bias the second bladder to a deflated position.

15. The helmet of claim 14, further comprising:

a pump in communication with the first bladder and the second bladder, the pump being configured to simultaneously inflate the first bladder and the second bladder, the helmet shell concealing the pump.

16. The helmet of claim 14, further comprising:

a pressure release valve in communication with the first bladder and the second bladder, the pressure release valve being configured to simultaneously at least partially deflate the first bladder and the second bladder to decrease the passive noise cancellation for the user, the helmet shell concealing the pressure release valve.

* * * * *